US006115858A

United States Patent [19]

Mitchell

[11] Patent Number: 6,115,858

[45] Date of Patent: Sep. 12, 2000

[54] TELESCOPING BED SLAT

[75] Inventor: Herbert L. Mitchell, Asheboro, N.C.

[73] Assignee: B&H Panel Company, Asheboro, N.C.

[21] Appl. No.: 09/006,244

[22] Filed: Jan. 13, 1998

Related U.S. Application Data

[63] Continuation of application No. 08/828,648, Mar. 31, 1997, Pat. No. 5,815,860.

[51] Int. Cl.[7] ..... A47C 19/02

[52] U.S. Cl. ..... 5/200.1; 5/201; 5/236.1; 5/238; 5/310

[58] Field of Search ..... 5/131, 185, 200.1, 5/201, 202, 236.1, 238, 285, 288, 310

[56] References Cited

U.S. PATENT DOCUMENTS

| | | | |
|---|---|---|---|
| 544,615 | 8/1895 | Fraser | 5/236.1 |
| 586,550 | 7/1897 | Foster . | |
| 587,864 | 8/1897 | Ryan et al. | 5/236.1 |
| 674,725 | 5/1901 | Bergman et al. . | |
| 697,102 | 4/1902 | Pack . | |
| 779,622 | 1/1905 | Pieper . | |
| 819,631 | 5/1906 | Bollinger . | |
| 934,607 | 9/1909 | Grenier . | |
| 985,355 | 2/1911 | Lockhart . | |
| 1,319,576 | 10/1919 | Durden . | |
| 1,504,807 | 8/1924 | Brotherton, Jr. et al. | 5/236.1 |
| 1,640,754 | 8/1927 | Covey . | |
| 1,676,987 | 7/1928 | Line . | |
| 1,716,243 | 6/1929 | Rooks . | |
| 2,452,808 | 11/1948 | Tucker | 5/209 |
| 2,606,329 | 8/1952 | Connally | 5/238 |
| 2,676,339 | 4/1954 | Collins | 5/236 |
| 2,707,288 | 3/1955 | Sands | 5/131 |
| 2,877,470 | 3/1959 | Roth et al. | 5/131 |
| 2,886,832 | 5/1959 | Mitchell et al. | 5/236.1 |
| 3,646,623 | 3/1972 | Harris et al. | 5/185 X |
| 3,761,970 | 10/1973 | Fredman | 5/202 |
| 4,019,211 | 4/1977 | Spitz | 5/202 |
| 4,704,751 | 11/1987 | Guerra | 5/236 |
| 5,203,039 | 4/1993 | Fredman | 5/202 |

OTHER PUBLICATIONS

Liggett & Platt Inc., price list and assembly instructions; Jan. 30, 1995.

Glideaway Bed Carriage Manufacturing Co.; Assembly Instructions—Undated, Admitted Prior Art.

*Primary Examiner*—Michael F. Trettel

*Attorney, Agent, or Firm*—Rhodes & Mason, PLLC

[57] ABSTRACT

The invention is a telescoping bed slat easily assembled for beds of various widths and heights. In particular, the invention includes a telescoping slat, one or more telescoping supports and securable mounts at terminal ends of the slat for anchoring the slat to respective bed rail cleats. Each slat includes two telescopically joined tubular sections. Preferably, the tubular sections are rectangular and include coinciding, longitudinally extending slots. The supports include a mounting head portion adapted to slideably engage the coinciding slots and extend downward from the slat toward a floor.

The supports may include two telescoping tubular sections. An upper section attaches to the mounting head portion which slideably engages and extends within the slat via the longitudinally extending slot. A lower section attaches to a threadably mounted fine adjustment that permits fine adjustments in the height of the support. In the preferred embodiment, the tubular sections of the support are rectangular and include a series of through-extending apertures adapted to receive a pin, bolt or dowel in order to set the desired height of the support.

19 Claims, 3 Drawing Sheets

TELESCOPING BED SLAT

This is a continuation application claiming the benefit of application Ser. No. 08/828,648 filed Mar. 31, 1997, now U.S. Pat. No. 5,815,860 entitled TELESCOPING BED SLAT in the name of Herbert L. Mitchell, pending, the disclosure of which is incorporated herein by reference.

BACKGROUND OF THE INVENTION

The present invention is directed generally to a telescoping bed slat, and in particular, to a telescoping bed slat economical to manufacture, easy to assemble and readily adapted to beds of varying heights and widths.

Bed slats extend between the rails of wooden beds to support the box springs and mattress. Metal beds generally have rails with one or more hingeable slat sections extending perpendicularly from the rails which engage a mating slat sections to form a bed frame having two or more horizontal supports. The opposing slat sections typically include pins adapted to extend through apertures in the mating slat portion to secure the frame. Wooden beds, on the other hand, include wooden bed rails with cleats extending along the inside length of the rail. Bed slats rest upon the top surface of these cleats, and the box springs and mattress are placed thereon. Historically, wooden bed slats were precut to fit each bed. Throughout the years, beds of varying widths were standardized. Although the standard bed sizes are full, queen, king and California-king, certain of these beds falling within one category may require slats of different lengths.

The emphasis on manufacturing articles of higher quality and lower cost grew in parallel with the desire to provide a bed which is easy to assemble. Currently, many suppliers deliver and assemble the bed in the customer's home, creating an even greater emphasis on the need for quick and easy assembly.

Bed manufacturers do not typically manufacture the slat assembly and must purchase these assemblies from other suppliers, such as B & H Panel Co., 230 West Academy Street, Asheboro, N.C. 27204. The manufacturers demand a high quality, low cost product which is easy for retailer's delivery personnel to assemble. Various attempts at providing bed slats of varying lengths have failed because they were complex and expensive to manufacture.

These systems were difficult to assemble and required a number of tools for assembly. For example, U.S. Pat. No. 2,886,832, to Mitchell et al. discloses an adjustable bed slat having telescoping sections with respective pawl and ratchet means. The Mitchell et al. slat is expensive to manufacture because of the pawl and ratchet means and fails to provide any type of central support, let alone a versatile and economical vertical support operable on a multitude of bed heights.

U.S. Pat. No. 2,452,808 to Tucker, discloses a telescoping bed slat having two sections, each having an L-shaped bracket adapted to engage a bed rail cleat. The first section includes a threaded rod extending from a first bracket and the second section includes a tap cylinder extending from the other bracket. The Tucker system requires welding the brackets onto the respective sections, tapping a cylinder and providing a threaded rod, all of which boost the cost of manufacture out of the bounds of economic reality. Furthermore, there is no way to connect one or more vertical supports to the Tucker slat in an economically efficient manner.

U.S. Pat. No. 1,504,807 to Brotherton, Jr. et al. discloses a telescoping bed slat wherein the respective ends are attached to the bed rails, but do not rest on cleats on the rail. Brotherton, Jr. et al. teach attaching the ends of the slat to a mounting bracket on the bed rail using a pin or hook configuration. The telescoping sections are bolted together at the center of the slat, thus, requiring additional materials for manufacture and tools for assembly. Additionally, there is no way to provide one or more supports along the Brotherton, Jr. et al. slat.

Thus, there remains a need for an economical bed slat system which is easy to assemble and easily adapted to fit beds of varying widths and heights. There is a need for a bed slat adjustable to various widths having one or more adjustable supports to adjust the height desired bed height. There is a further need to provide uniform supports adapted to work with a telescoping slat requiring one, two or more supports. A need remains for a slat support system substantially reducing the number of tools required to assemble the slat and support system.

SUMMARY OF THE INVENTION

The invention fulfills these needs by providing a telescoping bed slat easily assembled for beds of various widths and heights. In particular, the invention includes a telescoping slat, one or more telescoping supports and securable mounts at terminal ends of the slat for anchoring the slat to respective bed rail cleats. Each slat includes two telescopically joined tubular sections. Preferably, the tubular sections are rectangular and include coinciding, longitudinally extending slots. The supports include a mounting head portion adapted to slideably engage the coinciding slots and extend downward from the slat toward a floor.

The supports may include two telescoping tubular sections. An upper section attaches to the mounting head portion which slideably engages and extends within the slat via the longitudinally extending slot. A lower section attaches to a threadably mounted fine adjustment that permits fine adjustments in the height of the support. In the preferred embodiment, the tubular sections of the support are rectangular and include a series of through-extending apertures adapted to receive a pin, bolt or dowel in order to set the desired height of the support.

The head portion of the support foot includes an upper portion which slides within the slat, a lower portion extending within the upper member of the support, and opposing sides having channels slideably engaging portions of the tubing members defining the slot in the slat. The mounting head portion is made of a molded styrene or other durable plastic, and the channels are adapted to slideably engage the slat at portions in which the telescoping sections overlap and portions in which they do not overlap. This flexibility allows one support configuration to work on beds requiring one or more supports at various positions along the length of the slat.

In the preferred embodiment, the ends of the slats include a molded styrene or other plastic insert mounted within, and at terminal ends of the slat. The inserts and terminal ends of the slat include apertures through which a pin or dowel is inserted to attach the respective terminal ends to a bed rail cleat. The cleat will generally include corresponding predrilled holes sized to receive the pin or dowel. During set-up of a bed using the telescoping slat, one simply mounts one or more supports to one of the telescoping members by sliding the mounting head portion within the tubular sections, followed by telescopically engaging the members to form a single slat of the desired width of the bed. Next, pins or dowels are inserted through the ends of the slats into the bed rail cleat, and the supports are slid to the desired position. The telescoping sections of the supports are used to roughly set the support heights The fine adjustment attached to the bottom section of the support is used to adjust the support to the exact desired height. The invention provides a bed slat system for beds of varying heights and widths which is easy to assemble and disassemble while minimizing manufacturing cost. The invention further eliminates the need for different mounting configurations for supports and the need for centrally clamping the bed slat, both of which minimize the amount of hardware and tools required to manufacture and assemble each slat.

BRIEF DESCRIPTION OF THE DRAWINGS

The invention will be better understood from a review of the drawings in which.

DESCRIPTION OF THE PREFERRED EMBODIMENTS

Figure 1:
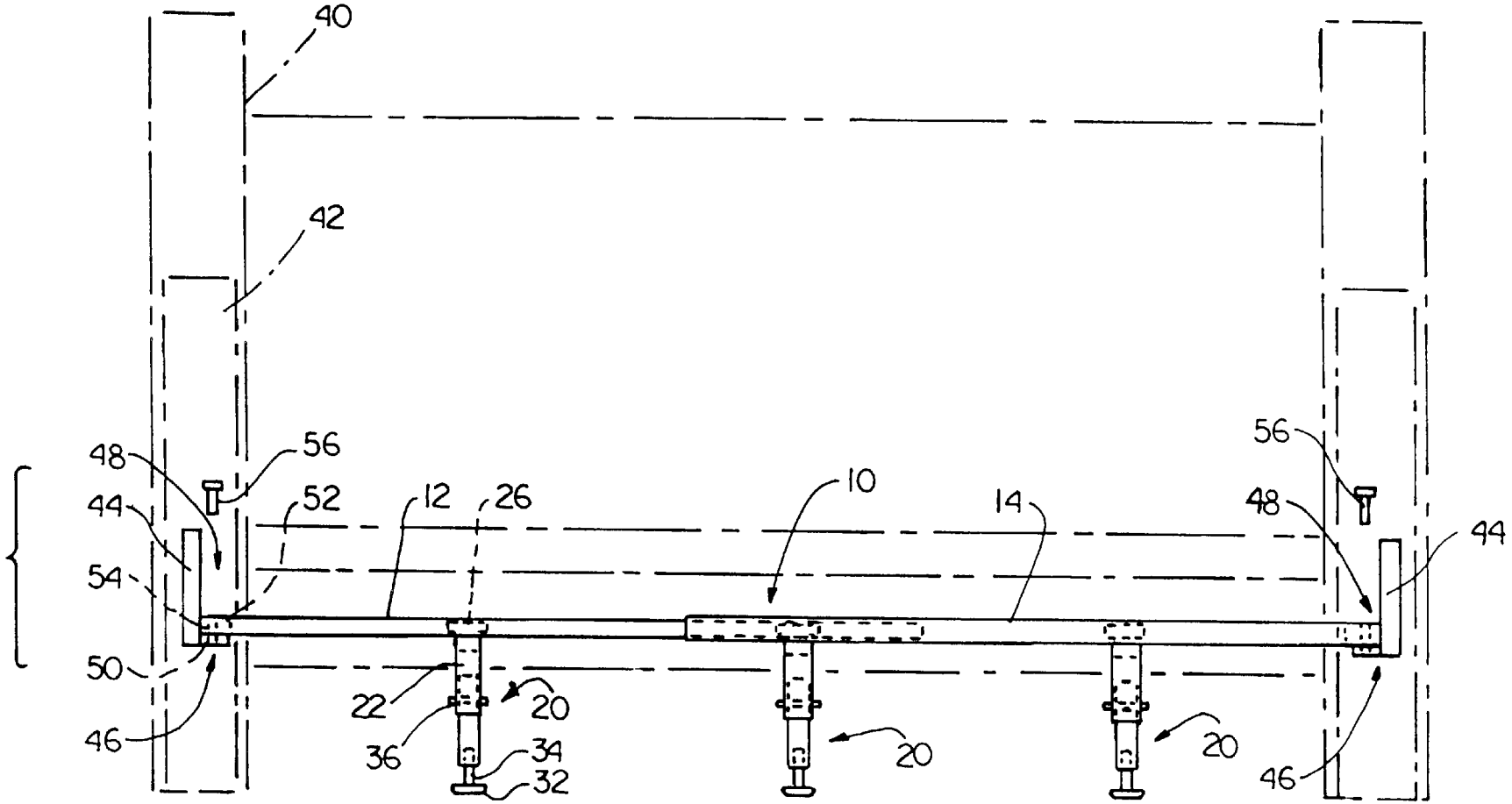
FIG. 1 depicts a telescoping bed slat constructed according to a preferred embodiment of the present invention located in a bed, shown in phantom.
Figure 2:
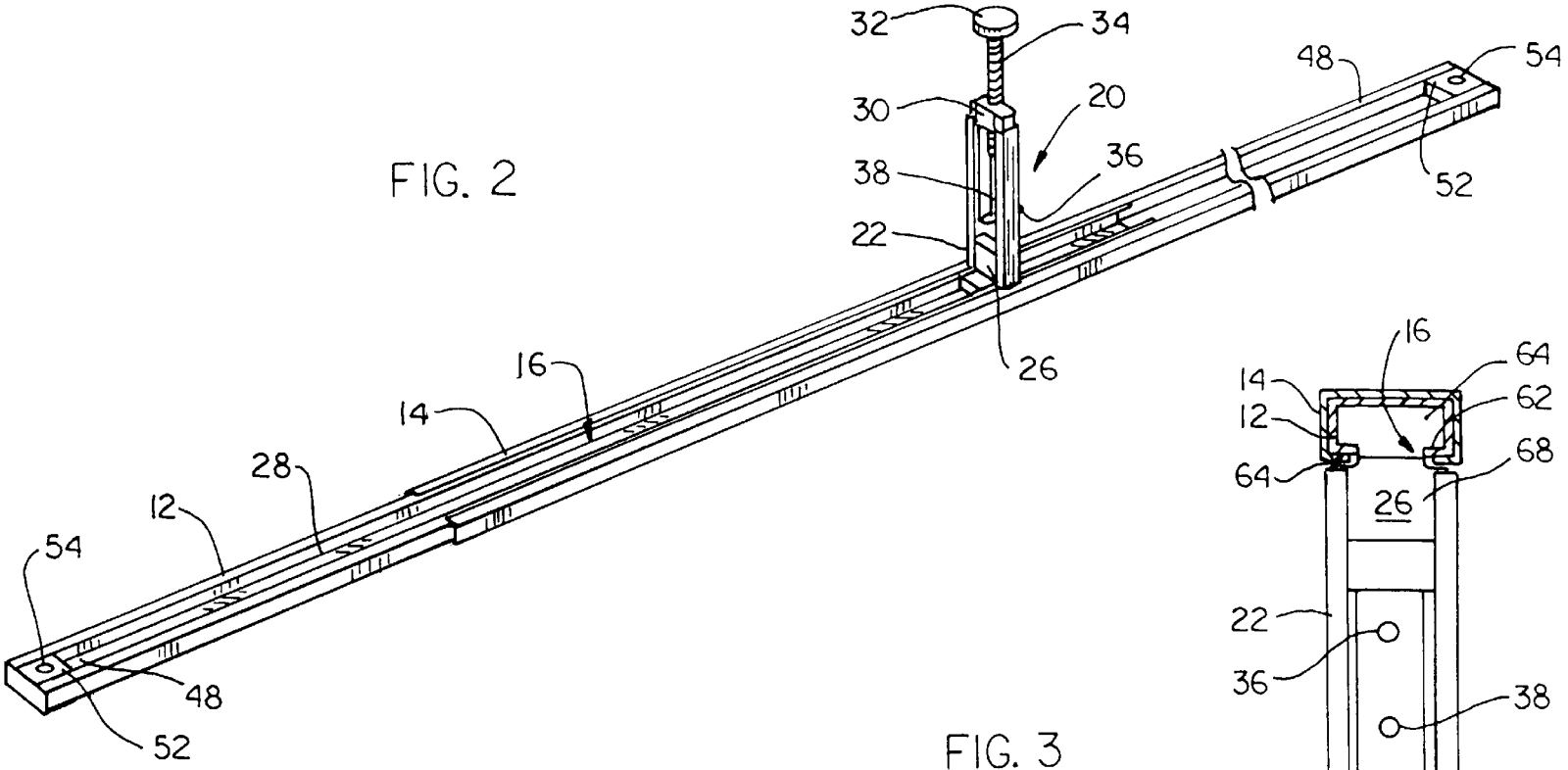
FIG. 2 is a perspective view of the telescoping bed slat of FIG. 1.

Referring now to the drawings in general and FIGS. 1 and 2 in particular, a telescoping bed slat 10 is depicted having an inner telescoping tubing member 12 and an outer telescoping tubing member 14. Both members 12, 14 are adapted such that the inner telescoping 12 readily slides within the outer telescoping tubing member 14. Each tubing member 12, 14 is of sufficient length to enable the telescoping slat 10 to extend to lengths along a continuum fitting multiple bed widths and configurations. In the preferred embodiment, each tubing member 12, 14 is approximately$_{13}$inches long and fits queen (5'- 0") and king (6'- 0" or 6'- 6") size beds. It is important that the telescoping members 12, 14 of the slat 10 overlap sufficiently to provide the slat 10 with adequate longitudinal integrity. For example, the telescoping members 12, 14 may overlap$_{13}$inches for a queen size bed. The overlap provides reinforcement at a zone of maximum exposure to flexing or bending.

The telescoping slat 10 includes a slot 16 extending longitudinally along its length. The slot 16 is formed from coinciding slots in the telescoping members 12, 14. The telescoping members 12, 14 preferably have a generally rectangular cross-section, but may be of any geometrical shape allowing for a telescoping cooperation between the telescoping members 12, 14 to form the slat 10 securely engage the bed rails and provide longitudinal stability. The slat 10 is formed so that the slot 16 faces downward once the slat 10 is mounted to the bed.

One or more vertical slat supports 20 are provided, the number depending on the width of the bed and the amount of additional support desired. Full and queen size beds generally have a centrally located support while king size beds use two supports substantially equally spaced between the bed rails 44. The support 20 is preferably adjustable and includes an upper support member 22 and a lower support member 24. The support 20 is adapted to slideably engage the slot 16 of the slat 10. At the top of the upper support member 22, a head portion 26 slideably engages the slot 16 and is press-fit into the upper support member 22.

The head portion 26 is designed to slideably engage the slot 16 throughout the length of the slat 10 regardless of whether or not the head portion 26 is engaging the inner telescoping tubing member 12, the outer telescoping member 14 or the central portion of the slat 10 where the telescoping tubing members 12, 14 overlap. Thus, beds requiring only one, centrally located support 20 may use the same type of support 20 as beds requiring multiple supports 20 where each support is located outside of the central area of the slat 10 where the tubing members 12, 14 overlap. In short, the head portion 26 is configured to slideably engage the slat 10 where the tubing sections 12, 14 overlap and where they do not. Such a universal configuration reduces the cost of manufacturing and simplifies assembly.

Preferably, the upper and lower support members 22, 24 telescopically engage one another and have a series of through-extending support apertures 38 adapted to receive a pin 36 to set the approximate height of the support 20 to provide rough height adjustments to accommodate beds of varying heights. however, unlike the tubing members 12, 14 of the slat 10, the upper and lower support members 22, 24 do not have to be telescopically arranged.

The lower support member 24 preferably includes a foot portion 30 for mounting a fine adjustment foot 32. The foot portion 30 is preferably tapped to receive a threaded shaft fixedly attached to the fine adjustment foot 32. Fine adjustments to the height of the support are provided by turning the fine adjustment foot 32 clockwise or counterclockwise.

The slat 10 is preferably used with a wooden bed having a head board 40, foot board 42 and wooden bed rails 44 having wooden bed rail cleats 46 for receiving terminal ends 48 of the slat 10. Preferably, the terminal ends 48 of the slat 10 rest on a top portion of the bed rail cleats 46 and against the inside portion of the bed rail 44. Importantly, the terminal ends of the slat 10 are adapted to engage the bed rail cleats 44 and/or the bed rails 44. Although the terminal ends 48 of the slats 10 may be adapted to engage the bed rail cleats 46 and/or the bed rails 44, it is preferable to provide a press-fit insert 52 having a vertically-oriented, through-extending aperture 54 within the terminal ends 46 of the slat 10. The insert 52 is designed such that the aperture 54 corresponds and aligns with vertically oriented predrilled holes 50 in the cleats 46. During assembly, a pin 56 is inserted through the aperture 54 in the insert 52 and into the holes 50 in the cleat 46 in order to secure the slat 10 to the respective bed rails 44. No other means of preventing axial extension of retraction of the telescoping slat 10 is necessary, thereby reducing the need for clamps, pins or ratchet means to axially stabilize the slat. The tubing members 12, 14 overlap sufficiently to provide lateral integrity and the terminal ends 48 of the slat 10 are secured to the respective bed rails 44. Each bed typically includes at least two slats 10 spaced along the length of the bed.

Notably, any type of suitable connection system is acceptable as an attachment means to connect the terminal ends 48 to the bed rails 44. The ends may be configured to snap onto or into the bed rail 44 or cleat 46, to include an integral pin extending into a corresponding hole 50, to engage a pin or look extending from the bed rail 44 or cleat 46 or latch into or over a ridge in the rail 44 or cleat 46, just to name a few alternatives. The manner in which the ends are connected is not as important as making sure that the ends are connected in some manner. No other means for axially securing the slat 10 is used.

Figure 3:
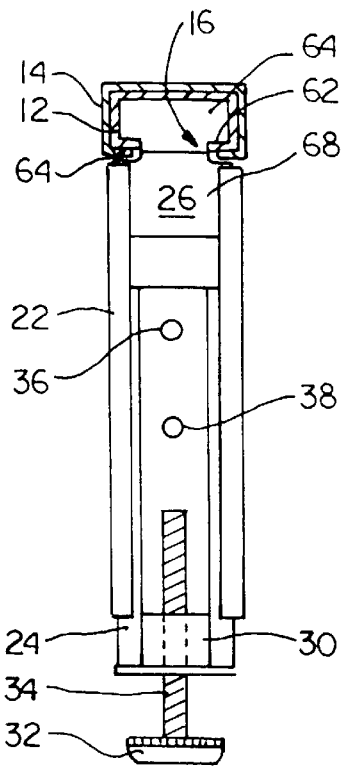
FIG. 3 is a side view of a support constructed according to the present invention.
Figure 4:
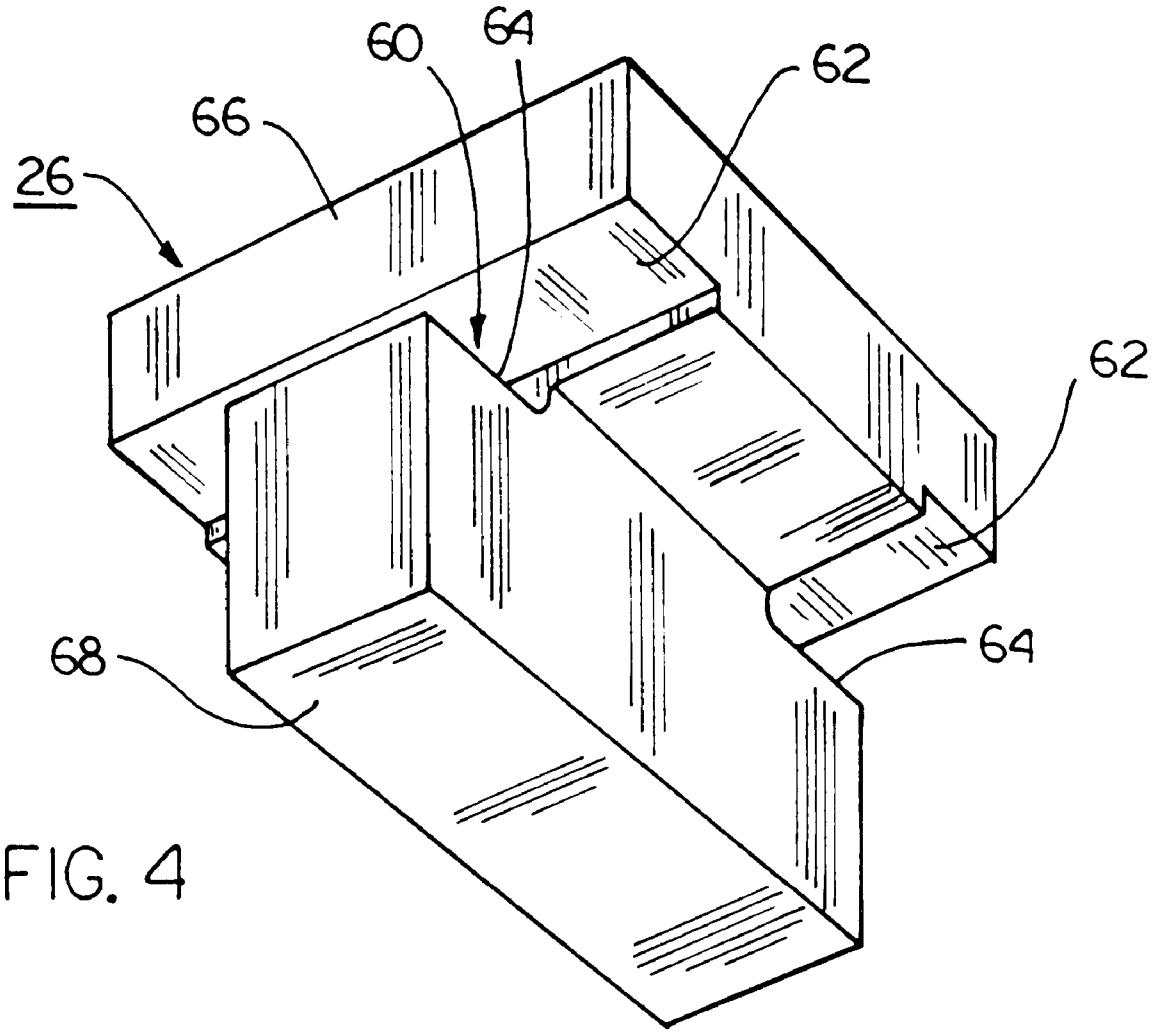
FIG. 4 is a perspective view of a mounting head portion for the support of FIG. 3.

FIGS. 3 and 4 depict the head portion 26 used to slideably engage the support 20 into the slot 16 of the slat 10. The head portion 26 includes channels 60 for receiving the edges of the respective tubing members 12, 14 defining the slot 16. Each of the channels 60 are defined by an upper shoulder 62 and a lower shoulder 64. The shoulders 62, 64 are spaced apart sufficiently to make the channel 60 wide enough to provide slidable engagement with overlapping tubing member 12, 14 while being narrow enough to minimize wobble when the channels engage those portions of the slat 10 which do not overlap. The upper portion of the mounting head portion 26 may substantially fill the interior of the telescoping slat 10. The upper portion cannot be larger than the inner portion of the inner telescoping tubing section 12 to enable the head portion to slide along the entire length of the slat 10. The lower portion of the mounting base 26 is adapted to be press-fit or otherwise secured in the uppermost portion of the upper support member of the support 20. The mounting head portion 26, inserts 52, foot portion 30 and the fine adjustment foot 32 are preferably made of a durable material, such as plastic, steel, polyethylene, nylon or any number of materials with like durability.

During assembly of the bed, the head and foot boards 40, 42 are attached to the bed rails 44. One or more vertical supports 20 are slideably attached to one of the telescoping tubing members 12, 14 via the mounting head portion 26 and the slot 16. The telescoping members 12, 14 are telescopically engaged. The slat 10 is adjusted to the width of the bed and the apertures 54 of the insert 52 are aligned with the predrilled holes 50 in the respective bed rail cleats 46. Pins 56 are pressed or hammered in place to secure the slat 10 to the bed rails 44. Preferably, the tool used to insert pins 56 is the only tool, if any, needed for assembly. Next, the supports 20 are placed as desired along the slat 10 and a rough adjustment of the length of the support 20 is made by adjusting lower support member 24 to a position where certain of the support apertures 38 in members 22 and 24 align. The pin 36 is inserted into the aligned apertures to fix the length of each support 20. Fine adjustment to support height is made by turning the fine adjustment foot 32 in a clockwise or counterclockwise direction until the foot contacts the floor and supports the slat 10 at the desired height.

We claim:

1. An adjustable bed rail slat system connectable between two bed rails comprising:

a first tubular member having a slot;

a second tubular member having a slot;

said second member telescopically engaging said first member to form a telescoping slat having coinciding, longitudinally extending slots;

said telescoping slat having opposing terminal ends adapted to securely mount said slat to wooden bed rails;

said slat being free of securement means between said tubular members restricting axial compression or extension of said slat; and a downwardly extending support having a head portion slideably engaging said telescoping slat along said coinciding, longitudinally extending slots wherein said members are tubular and have a generally rectangular cross-section, said cross-section including a top wall adjoining two downwardly extending side walls and two bottom walls extending inwardly from respective lower ends of said side walls to define a slot between said bottom walls.

2. The adjustable bed rail slat system of claim 1 wherein said terminal ends include inserts adapted to press-fit into the bed rail.

3. The adjustable bed rail slat system of claim 2 wherein each said insert includes an aperture adapted to align with an opening on a bed rail cleat and further comprising a pin extending through said apertures into the bed rail opening to provide engagement of said slat to the bed rails.

4. The adjustable bed rail slat system of claim 2 wherein said inserts are integrally formed and mounted on said opposing terminal ends of said slats.

5. The adjustable bed rail slat system of claim 1 wherein said downwardly extending support includes a lower member and an upper member with said head portion mounted at an upper end of said upper member, said lower member adapted to moveably attach to said upper member to provide height adjustments of said support.

6. The adjustable bed rail slat system of claim 5 wherein said upper and lower members telescopically engage one another.

7. The adjustable bed rail slat system of claim 5 wherein said support includes a line adjustment foot threadably engaging a foot portion at a lower end of said lower member to provide fine height adjustments of said support.

8. The adjustable bed rail slat system of claim 1 wherein said head portion includes opposing sides, each having a recessed channel forming an upper shoulder and a lower shoulder, said channel sized to receive opposing edges of said slat which define a slot in said slat.

9. The adjustable bed rail slat system of claim 8 wherein said channels are sized to receive said opposing edges of said slat where said first and second tubular members overlap as well as portions of said slat where said first and second tubular members do not overlap.

10. An easy to assemble bed comprising:

a head board;

a foot board;

two wooden bed rails connecting respective ends of said head board to said foot board and having bed rail cleats along an inside surface of said bed rails;

at least two tubular telescoping bed slats, each slat having lower sides opposing ends, and a longitudinally extending slot, said opposing ends having attachment means for connecting said bed slat to said bed rail cleats of sad bed rails, said attachment means providing the only connection means for preventing retraction of said slat; and each of said bed slats including a vertically adjustable support engaging said lower side of said slat, said support including a head portion slidable along said longitudinally extending slot;

each said bed rail cleat adapted to receive a respective one of said attachment means of said bed slats.

11. The adjustable bed rail slat system of claim 1 wherein said support is tubular and has a rectangular cross-section.

12. An adjustable bed rail slat system connectable between two bed rails comprising:

a first tubular member having a slot;

a second tubular member having a slot;

said second member telescopically engaging said first member to form a telescoping slat having coinciding, longitudinally extending slots;

said telescoping slat having opposing terminal ends adapted to securely mount said slat to wooden bed rails;

said slat being free of securement means between said tubular members restricting axial compression or extension of said slat; and a downwardly extending support having a head portion slideably engaging said telescoping slat along said coinciding, longitudinally extending slots wherein said head portion has opposing sides with recessed channels adapted to engage opposing edges of said slat which define a slot in said slat.

13. The adjustable bed rail slat system of claim 12 wherein said channels are adapted to slideably engage said opposing edges where said members of said slat overlap and also where said members do not overlap.

14. The adjustable bed rail slat system of claim 13 wherein said head portion further includes an upper portion adapted to slideably travel within an interior of said slat and a lower portion adapted to fixedly engage said support.

15. An adjustable bed slat assembly comprising:

a tubular telescoping slat having a lower side and opposing ends, said opposing ends having attachment means for connecting said ends to respective bed rails, and a longitudinally extending slot; and a vertically adjustable support, said vertically adjustable support slideably engaging said lower side of said slat along said longitudinally extending slot, said attachment means of said slat providing the only means for preventing retraction of said telescoping slat.

16. An easy to assemble bed comprising:

a head board;

a foot board;

two wooden bed rails connecting respective ends of said head board to said foot board and having bed rail cleats along an inside surface of said bed rails;

at least two tubular telescoping bed slats, each slat having lower sides and opposing ends, said opposing ends having attachment means for connecting said bed slat to said bed rail cleats of said bed rails, said attachment means providing the only connection means for preventing retraction of said slat; and said bed slats including a vertically adjustable support engaging said lower side of said slat;

each said bed rail cleat adapted to receive a respective one of said attachment means of said bed slats.

17. An adjustable bed rail slat system connectable between two bed rails comprising:

a first tubular member having a slot;

a second tubular member having a slot;

said second member telescopically engaging said first member to form a telescoping slat having a longitudinally extending slot;

said slat having a lower side and means at opposing ends for securely mounting said slat to wooden bed rails;

said slat having opposing terminal ends to securely mount said slat to wooden bed rails;

said slat being free of securement means between said tubular members restricting axial compression or extension of said slat; and a downwardly extending support having a mounting means for slideably engaging said lower side of said telescoping slat along said longitudinally extending slot, said support including a lower member and an upper member with said mounting means mounted at an upper end of said upper member, said lower member adapted to moveably attach to said upper member to provide height adjustments of said support.

18. An adjustable bed rail slat system for assembly of a bed having a head board, a foot board, and two wooden bed rails connecting respective ends of the head board to the foot board and having bed rail cleats along an inside surface of said bed rails, said slat system comprising:

at least two tubular telscoping bed slats, said slats having lower sides, each slat having opposing ends with attachment means for connecting said bed slat to said bed rail cleats of said bed rail, said attachment means providing the only connection means for preventing teescoping of an installed slat; said slat including a longitudinally extending slot extending between said opposing ends; and said bed slats including a vertically adjustable support engaging said slat on said lower side of said slat, said support being slidable alnong said slot between said ends;

each said bed rail cleat adapted to receive respective said attachment means of said bed slats.

19. An adjustable bed rail slat system for assembly of a bed having a head board, a foot board, and two wooden bed rails connecting respective ends of the head board to the foot board and having bed rail cleats along an inside surface of said bed rails, said slat system comprising:

at least two tubular telescoping bed slats, said slats having lower sides, each slat having opposing ends with attachment means for connecting said bed slat to said bed rail cleats of said bed rail, said attachment means providing the only connection means for preventing telescoping of an installed slat; and said bed slats including a vertically adjustable support engaging said slat on said lower side of said slat;

each said bed rail cleat adapted to receive respective said attachment means of said bed slats.

* * * * *

UNITED STATES PATENT AND TRADEMARK OFFICE

CERTIFICATE OF CORRECTION

PATENT NO. : 6,115,858
DATED : September 12, 2000
INVENTOR(S) : Herbert L. Mitchell It is certified that error appears in the above-identified patent and that said Letters Patent is hereby corrected as shown below:

Title page,
Please delete the following:
-- [73] Assignee: B&H Panel Company, Asheboro, N.C. --

Signed and Sealed this

Third Day of June, 2003

JAMES E. ROGAN
*Director of the United States Patent and Trademark Office*